United States Patent [19]

Hanft

[11] Patent Number: 4,941,424

[45] Date of Patent: Jul. 17, 1990

[54] DOOR ALARM

[76] Inventor: Herbert Hanft, 3609 Cameron Mills Rd., Alexandria, Va. 22305

[21] Appl. No.: 258,638

[22] Filed: Oct. 17, 1988

[51] Int. Cl.[5] ..... G08B 13/08

[52] U.S. Cl. ..... 116/85; 116/6; 116/155

[58] Field of Search ..... 116/85, 86, 88, 92, 116/95, 96, 97, 12, 155, 157, 152, 153, 156, 163, 160, 167, 6

[56] References Cited

U.S. PATENT DOCUMENTS

| | | | |
|---|---|---|---|
| 386,164 | 7/1883 | Sanderson | 116/157 |
| 515,260 | 2/1884 | Smith | 116/85 |
| 517,869 | 4/1884 | Lawlor | 116/12 |
| 667,799 | 2/1901 | Shore | 116/12 |
| 929,590 | 7/1909 | Hartwell | 116/85 |
| 1,296,982 | 3/1919 | Lohrens | 116/12 |
| 1,398,362 | 10/1921 | Cook | 116/83 |
| 1,419,738 | 6/1922 | Klomfass | 116/86 |
| 1,567,921 | 12/1925 | D'Almaforte | 116/12 |
| 2,760,460 | 8/1956 | Short | 116/85 |
| 3,013,523 | 12/1961 | Phillips | 116/86 |
| 3,895,599 | 7/1975 | Berkowitz | 116/95 |
| 4,523,184 | 6/1985 | Abel | 340/539 |
| 4,567,846 | 2/1986 | Kurtz | 116/86 |

*Primary Examiner*—Allan N. Shoap
*Assistant Examiner*—Jeffrey J. Hohenshell
*Attorney, Agent, or Firm*—Browdy and Neimark

[57] ABSTRACT

A sonic alarm device is provided for signalling the opening of a door which is hingedly mounted adjacent the edge on a door frame for swinging movement about an upright hinge axis into and out of a closed position. The door alarm is mounted in the interior of the door. The door alarm comprises a housing for the alarm, an isolator inside of the housing, wherein the isolator supports a sonically activated device. A spring holder is mounted within the isolator, and spring is mounted on the spring holder in a position horizontal to the door. When the door is in a closed position, the spring is pushed back into the interior of the housing; the spring is designed to be released when the door is opened. A hammer actuator is contacted by the spring when the door is opened, and a hammer is struck by the hammer actuator when the door is opened. The hammer then contacts a sonically actuated device to cause the device to produce an audible sound.

5 Claims, 3 Drawing Sheets

DOOR ALARM

FIELD OF THE INVENTION

The present invention relates to an alarm that can be incorporated in a door to signal the opening or closing of the door.

BACKGROUND OF THE INVENTION

Many doors are constructed without windows in the top thereof, so that, when they are opened, the person opening the door is not able to see if there is another person on the opposite side of the door. This is particularly a problem with doors which open into or out of stairwells, restroom doors, and the like. In many instances, such as with restroom doors, it is undesirable to make part of the door transparent in order to view someone on the other side prior to opening the door. With respect to doors leading to stairwells, transparent sections in the doors render the doors more expensive than if they were made solid. Additionally, fire codes in some jurisdictions require that doors leading to specific exits be sufficient to prevent the spread of fire from a stairwell, so that doors leading to a stairwell must be of a certain strength.

Some public laws require that certain doors remain open at all times, so that it would be useful to have some means of monitoring the opening and closing of such doors.

Where young children are present, it would be particularly useful to have doors which make an audible sound when opened so that the caregiver is aware of a child's movement through the home, particularly when the door opens into a stairwell. These households may also find it prudent to provide alarms on cupboard doors so that the child's activities are monitored, particularly for cupboards in which potentially hazardous materials are stored.

A number of solutions have been sought for this problem of providing a warning when a door is to be opened. However, none of the known solutions has been sufficiently practical to warrant the inclusion thereof in most doors, as most of them relate to burglar alarms.

D'Almaforte, in U.S. Pat. No. 1,567,921, discloses a door-fastening device which prevents opening of the door as well as providing an audible signal that an attempt is being made to open the door. This device comprises a rod having one end bent so as to engage the keeper plate of a door jamb, a pivoted member secured to the rod, a sliding member positioned in the pivoted member, an audible signal secured to the rod, and a push button controlling the signal. The rod operates the push button, and a spring is provided which is normally adapted to retain the sliding member out of contact with the push button. This device is designed to retain the door in a fastened position rather than merely to warn someone on the other side that the door is to be opened.

Phillips, in U.S. Pat. No. 3,013,523, discloses a door opening alarm for use in combination with a door frame having a lintel and a swingable door hingedly mounted therein. The alarm comprises a bell assembly supported by the lintel above the upper horizontal edge of the door. The bell assembly comprises a horizontal flat U-shaped bracket secured to the lintel. The bracket has horizontally extending arms perpendicularly disposed to the face of the lintel, and a bell supporting member is resiliently supported centrally of the bracket between the arms and a plurality of bells depending from the bell supporting member. Adjustable striker means are mounted on the door in proximity to the bells to sound an alarm only when the door is opened. The striker means are positioned inwardly of the bell supporting member. The adjustable striker means are adjustable in a vertical direction and including a pivoted cam means movable only in one direction. The cam means are provided with inclined surfaces contacting the bell supporting member in both the opening and closing directions.

Sanderson, in U.S. Pat. No. 386,164, discloses an alarm bell for doors comprising a door having a bell mechanism secured upon one side of a door or frame. A push button is provided for operating the bell, the push-button secured on the opposite side of the door or frame and connected through the door or frame by a connecting rod with the bell mechanism. The button has its frame formed with a projecting bevelled guide to aid in centering the button with the opening in the door or frame, and to prevent binding of the operative parts. This alarm requires a push upon the button in order to produce an alarm.

Cook, in U.S. Pat. No. 1,398,362, discloses a detonating alarm which is used as a burglar alarm in windows, doors, and the like. The alarm of this disclosure includes a holder for a detonator, a mounting for the holder including a flat spring, a base for the mounting including an impact receiver against which the holder may throw a detonator, and a trigger carried from the base to engage and hold the holder against spring action. The holder is carried and anchored by the flat spring against movement other than directly to strike the impact receiver when released by the trigger.

Lawlor, in U.S. Pat. No. 517,869, discloses a portable burglar alarm which can be easily transported and which can be applied to doors and windows so as to lock the same and which provides an audible notification when any attempt is made to force open the door or window to which it may be applied. The device consists of a base provided with a shank adapted to be introduced into the space between the door and its casing and to be turned, whereby a stud or tooth on its shank will engage with said casing. An alarm bell is secured to the base, having an alarm mechanism therein. An arm is mounted on the base in bearings, the arm being adapted to be mounted on the base in bearings and adapted to engage with at one and and trip the bell mechanism. A spring is provided for holding the arm normally out of engagement with the bell mechanism. A finger on the arm in the path of the door is adapted to move the arm and trip the bell mechanism when the door is opened and to engage with the bearing so as to lock the door.

Shore, in U.S. Pat. No. 667,799, discloses a combination door lock and alarm which is portable. The device includes a flat, screw-threaded stem having a detent of a door-engaging plate on the stem, outward of the plate, a nut or clamping head on the outer end of the flattened stem, and a bell having the projecting actuating stem and a slitted keeper. The keeper is adapted to embrace the stem and to secure the bell removably in operative position.

Klomfass, in U.S. Pat. No. 1,419,738, discloses a combination burglar alarm and lock which can be attached to a door jamb or casing in position for arrangement either in operative or inoperative position according to the preferences of the occupant of a room. The device comprises a base plate consisting of a hingedly connected attaching and swinging member of which the former is adapted to be secured to the inner surface of a door casing, a stop rod carried by the swinging member for terminal arrangement in the path of a door when the swinging member is disposed in perpendicular relation with the plane of the door, and means for securing the swinging member in its operative position, and consisting of a hook mounted upon the door casing for detachable engagement with the swinging member and arranged in bracing relation therewith.

Lohrens, in U.S. Pat. No. 1,296,982, discloses a combination burglar alarm and lock which cooperates with a door guard of the slotted hasp and latch type. The lock permits the door to be opened a few inches, but prevents the door from being further opened. The alarm comprises a door and its casing of a door guard comprising a hasp, a latch on the door for association with the hasp to lock the door in either closed or partially open position, means for mounting the hasp carried by the casing to permit limited bodily movement as well as pivotal movement thereof, a signal, and means actuated by the bodily movement of the hasp to initiate the signal.

SUMMARY OF THE INVENTION

It is an object of the present invention to overcome the aforementioned deficiencies in the prior art.

It is another object of the present invention to provide an alarm for a door that is set off when the door is first opened.

It is a further object of the present invention to provide an alarm for a door that is set off when the knob or lever opening the door is turned.

According to the present invention, a door alarm is provided which is set off when the knob or lever of the door is turned, however slightly. This alarm provides an audible warning to a person remote from the person opening the door that the door is about to be opened.

DETAILED DESCRIPTION OF THE INVENTION

The alarm device of the present invention can be incorporated into any type of door opened either with a conventional doorknob or with a lever. Alternatively, the alarm device of the present invention can be mounted in a door which is opened merely by pushing the door, such as a swinging door. The only limitation is that the door be fitted to its frame sufficiently that when the door is in its closed position, the plunger of the alarm device be pushed back into its retracted position.

Figure 1:
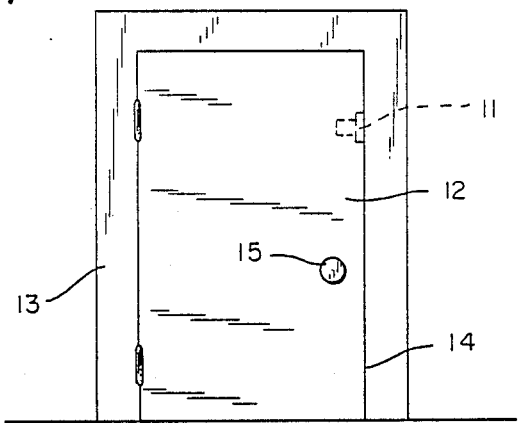
FIG. 1 shows a plan view of a door in which the alarm device of the present invention is incorporated.

Referring to FIG. 1, the alarm device of the present invention 11 is mounted on the interior of a door 12 which is hingedly mounted on a door frame 13. The door is preferably a hollow door into which the alarm device is mounted. Alternatively, a portion of the door slightly larger than the housing 27 of the alarm device can be hollowed out so as to hold the device. The housing 27 is generally of a rectangular configuration, but any convenient configuration for the housing can be used which fits easily inside of a door. When the door 12 is in its closed position, the alarm device 11 is flush with the side edge of the door 14 remote from the hinge.

Figure 2:
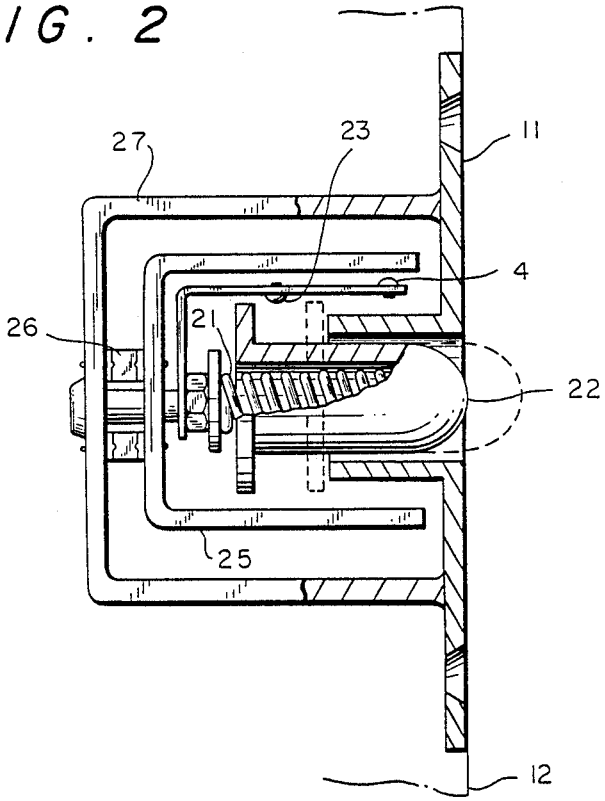
FIG. 2 shows a side view of the alarm device of the present invention.
Figure 5:
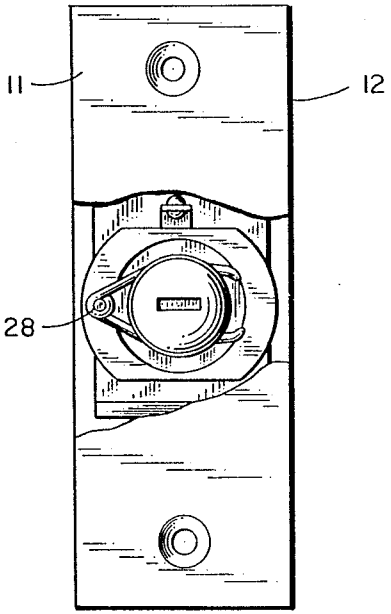
FIG. 5 shows a side view of the alarm according to the present invention.

FIG. 2 shows a side view of the alarm device according to the present invention, with the outside surface of the door shown at 12, with the doorknob shown at 15. The alarm device is located within a housing 27 which surrounds the entire alarm device. Isolator 26 sonically separates the chime 25 from the housing of the device. The spring 21 is mounted on a mounting device and held in position inside of the isolator and the housing. When the door is in the closed position, the spring 21 and plunger 22 are in the position shown by the solid lines. Opening the door causes the compression of the spring to be released, allowing the plunger 22 to move to a forward position, as shown by the dotted lines. Movement of the plunger 22 causes the hammer actuator 23 to move to activate the hammer 4, which contacts the sonically vibratable element, herein shown in the form of a chime 25, and causes the chime 25 to sound. The chime 25 is supported by the isolator, with which both the chime 25 and the housing 27 can be integrally molded. Of course, the chime is mounted so that it can vibrate relatively freely. The intensity of the sound produced by the chime is dependent upon the size of the chime, the force with which the hammer hits the chime, the material of which the chime is made, etc. A particularly suitable material for making the chime is hardened or tempered steel, which produces a loud, readily audible, clear sound.

Figure 3:
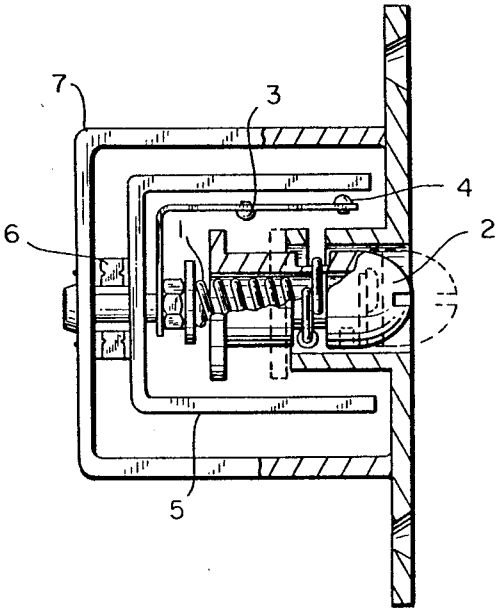
FIG. 3 shows a front end view of the alarm device according to the present invention.
Figure 6:
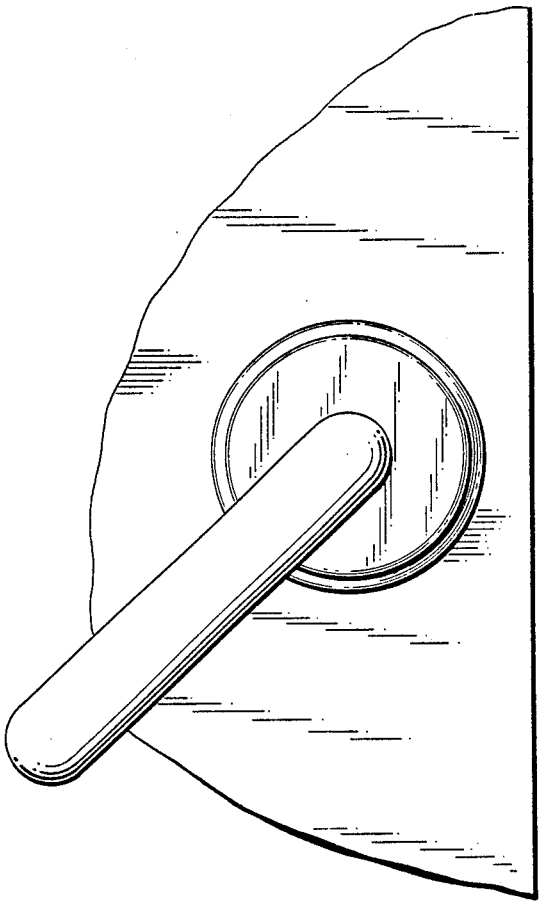
FIG. 6 shows a door having a lever for an opener.

FIG. 3 shows another embodiment of the present invention in which the alarm can be silenced by turning plunger 2 through a screwdriver slot one-fourth of a turn. The rotated position of the plunger 2 is held by the spring 28 preventing the actuator 3 from operating. This embodiment is particularly useful for an alarm device in a home, when the occupants only wish the alarm to be activated by a child's opening a door. When the child is asleep, it is advantageous to deactivate the alarm so that the opening the door does not disturb the sleeping child.

Figure 4:
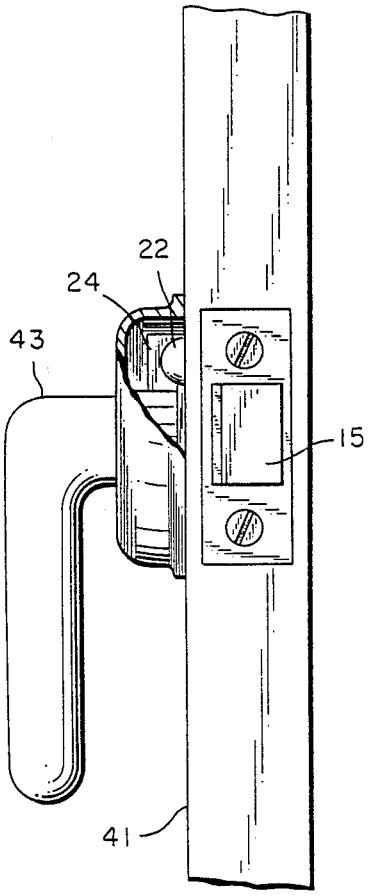
FIG. 4 shows a side view of a door which is openable by a lever, in which an alarm device according to the present invention is incorporated.

FIG. 4 shows a door 41 in which the device according to the present invention is incorporated when the door 41 is opened by means of a lever 43 rather than by a knob. The opening mechanism of the door does not affect the operation of the alarm system; it is the opening of the door per se that releases the compression on the spring to cause the sounding of the alarm.

In other embodiments of the present invention, modular chimes can be used which are activated electrically upon release of the spring. Alternatively, a transmitter can be incorporated in the alarm device so that a remote receiver for a security system can be notified that the door has been opened.

The housing for the alarm device can preferably be molded from a suitable rigid plastic. The plunger can also be molded of the same material.

It can readily be seen from the foregoing that the construction and operation of the alarm device of the present device can be readily understood. The alarm device of the present invention can be installed in doors opening either outwardly or inwardly, as the direction of motion of the door is not critical to release of the tension on the spring to activate the chime.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A sonic alarm device for signalling the opening of a closed door comprising:

a door hingedly mounted adjacent the edge of a door frame for swinging movement about an upright hinge axis into and out of a closed position;

said door having an exterior and an interior;

a door alarm mounted in the interior of said door;

said door alarm comprising a housing for said alarm in which said alarm is contained;

an isolator inside of said housing, said isolator supporting a sonically activated device and separating said sonically activated device from said housing;

a spring holder mounted within said isolator;

a spring mounted on said spring holder in position horizontal to the door, said spring being pushed back into the interior of said housing when the door is in a closed position, and released when the door is opened;

a plunger which is moved forward when said spring is released;

a hammer actuator which is contacted by said plunger when said door is opened;

a hammer which contacts said sonically activated device to cause said device to produce an audible sound.

2. The sonic alarm device according to claim 1 wherein the door is opened by a doorknob.

3. The sonic alarm device according to claim 1 wherein the door is opened by a lever.

4. The sonic alarm device according to claim 1 wherein said sonically activated device comprises modular chimes.

5. The sonic alarm device according to claim 1 wherein the housing is molded from a rigid plastic material.

* * * * *